US005595496A

United States Patent [19]

Konda et al.

[11] Patent Number: 5,595,496

[45] Date of Patent: Jan. 21, 1997

[54] WATER-PROOF CONNECTOR

[75] Inventors: Kazumoto Konda, Mie Pref.; Yoshihiko Hotta, Saitama Pref., both of Japan

[73] Assignee: Sumitomo Wiring Systems, Ltd., Mie Pref., Japan

[21] Appl. No.: 339,253

[22] Filed: Nov. 10, 1994

[30] Foreign Application Priority Data

Nov. 10, 1993 [JP] Japan ..... 5-305779

[51] Int. Cl.[6] ..... H01R 13/52

[52] U.S. Cl. ..... 439/271; 439/272; 439/281; 439/580

[58] Field of Search ..... 439/271–272, 439/281–282, 580

[56] References Cited

U.S. PATENT DOCUMENTS

| | | | |
|---|---|---|---|
| 4,193,655 | 3/1980 | Herrmann, Jr. | 439/569 |
| 4,284,312 | 8/1981 | Patchett et al. | 439/281 |
| 4,659,166 | 4/1987 | Morningstar et al. | 439/580 |
| 4,664,461 | 5/1987 | Schubert et al. | 439/271 |
| 4,675,779 | 6/1987 | Neuwirth | 439/271 |
| 4,767,350 | 8/1988 | Cooper et al. | 439/271 |

FOREIGN PATENT DOCUMENTS

| | | | |
|---|---|---|---|
| 0101155 | 2/1984 | European Pat. Off. | 439/272 |
| 2136022 | 2/1973 | Germany | 439/580 |
| 60-37184 | 3/1985 | Japan . | |
| 4-329273 | 11/1992 | Japan | 439/271 |
| 1539722 | 1/1979 | United Kingdom | 439/272 |
| 9320600 | 10/1993 | WIPO | 439/580 |

*Primary Examiner*—P. Austin Bradley
*Assistant Examiner*—Jill DeMello
*Attorney, Agent, or Firm*—Wenderoth Lind & Ponack

[57] ABSTRACT

A water-proof connector includes a first connector housing having a plurality of male terminals protruding from an end surface thereof; a second connector housing having an end surface provided with a plurality of cavities which correspond in number to the number of the male terminals and in each of which a female terminal is disposed; and a resilient seal member provided on the end surface of one of the first and second connector housings. The seal member has a plurality of openings so that, when the first and second connector housings are connected with each other, the male terminals are inserted through the openings into the corresponding cavities and are electrically connected with respective female terminals, with respective end surfaces thereof being in pressure engagement with each other through the seal member.

7 Claims, 6 Drawing Sheets

WATER-PROOF CONNECTOR

BACKGROUND OF THE INVENTION

1. Field of the Invention

This invention relates generally to a connector having a pair of connector housings adapted to be connected with each other and to electrically connect a plurality of terminals disposed therein and, more specifically, to a water-proof connector having a resilient seal member interposed between the connector housings to prevent water from infiltrating into inside of the connector.

2. Description of the Prior Art

Japanese Laid-Open Utility Model Publication No. 60-37184 discloses a water-proof connector as illustrated in FIG. 6, in which a pair of housings 60 and 70 having a plurality of female terminals 61 and a plurality of male terminals 71, respectively, are in abutting engagement with each other with respective male terminals 61 being fitted into corresponding female terminals 71 to establish an electrical connection therebetween. Provided at an end of the female housing 60 is a sleeve 62 within which the female terminals 61 are disposed. The sleeve 62 has an outer periphery provided with a flange 63 to which a seal ring 64 is fitted. The male housing 70 has a cylindrical hood 72 whose tip end is adapted to be in pressure engagement with the seal ring 64 to provide a water-proof structure. Thus, in the above water-proof connector, the female terminals 61 are surrounded by a common seal ring 64 so as to prevent water from penetrating into the sleeve 62. When the above connector is utilized, for example, for a charger of an electric car, the connector housings 60 and 70 are normally maintained in the disconnected state and are connected to each other only at the time of charging. Therefore, during the running of the car, water drops such as rain drops are apt to deposit on the exposed surfaces around the terminals 61 and 71. When such wet housings 60 and 70 are connected, an electrical current leaks between adjacent terminals through the water present between the end surfaces at which the housings 60 and 70 are engaged with each other.

SUMMARY OF THE INVENTION

It is, therefore, an object of the present invention to provide a water-proof connector in which leakage of an electrical current is prevented even when the connector housings are wet at their engaging surfaces.

Another object of the present invention is to provide a water-proof connector of the above-mentioned type which can provide a sufficient distance between adjacent terminals to minimize a possibility of forming leakage paths.

It is a further object of the present invention to provide a water-proof connector of the above-mentioned type which has a simple structure and which creates a perfect water-proofing effect.

In accomplishing the foregoing objects, there is provided in accordance with the present invention a water-proof connector which includes a first connector housing having a plurality of male terminals protruding from an end surface thereof, a second connector housing having an end surface provided with a plurality of cavities which correspond in number to the number of the male terminals and in each of which a female terminal engageable with the corresponding male terminal is disposed, and a resilient seal member provided on the end surface of one of the first and second connector housings and having a plurality of discrete openings, so that, when the first and second connector housings are connected with each other, the male terminals are inserted through the openings of the seal member into the corresponding cavities of the female housing and are electrically connected with respective female terminals, with respective end surfaces thereof being in pressure contact with each other through the seal member. The number of the openings of the resilient seal member may be the same as that of the male terminals so that each male terminal is insertible into a respective one of the openings. Alternatively, the number of the openings is smaller than that of the male terminals so that at least one of the openings accommodates two or more male terminals jointly.

As a result of the above structure, even when the first connector housing is connected with the second connector housing with at least one of the first housing, second housing and seal member being wet, the water is removed from the interfaces at which the end surfaces of the first and second housings are in pressure contact with the seal member. In this case, since the openings of the seal member are separated and independent from each other, there is no possibility of forming leakage paths between terminals disposed in respective openings. Namely, the water is divided by the seal member and is confined in discrete openings thereof, whereby an electrical current flowing through the terminal or terminals in one opening is prevented from leaking to the terminal or terminals in another opening even when water is present in each opening.

Preferably, the end surface of one of the first and second connector housings is provided with a plurality of annular protrusions which correspond in number to the number of the openings of the seal member and which are arranged to surround the circumferences of the corresponding openings when the first and second housings are connected with each other. By this expedient, the seal member between the end surfaces of the first and second housings is tightly pressed by the annular protrusions so that a more perfect sealing is attained as compared with the case where no such protrusions are formed.

It is also preferred that the end surface of the first connector housing be provided with a plurality of sleeves extending therefrom to surround respective male terminals and insertible into respective cavities of the second connector housing. In this case, since each of the male terminals is surrounded by a sleeve, the creeping distances between each male terminal and the peripheral edge of the end surface of the first housing and between two adjacent male terminals are increased, so that there is almost no possibility of forming a leakage path of water between them.

It is also preferred that the male terminals include relatively larger diameter, large current terminals and relatively smaller diameter, small current terminals and that the seal member be provided with a first group of openings and a second group of openings, so that the large current terminals are inserted through the first group of openings while the small current terminals are inserted through the second group of openings when the first and second connector housings are connected with each other. In this structure, even when leakage occurs from the large current terminals, a short circuit between the large current terminals and the small current terminals is prevented. Further, the structure of the seal member is simplified.

It is further preferred that the seal member be in the form of a plate for reasons of simplicity in structure and handling of the seal member.

BRIEF DESCRIPTION OF THE DRAWINGS

Other objects; features and advantages of the present invention will become apparent from the detailed description of the preferred embodiments which follows, when considered in light of the accompanying drawings in which.

DETAILED DESCRIPTION OF THE PREFERRED EMBODIMENTS OF THE INVENTION

Figure 1:
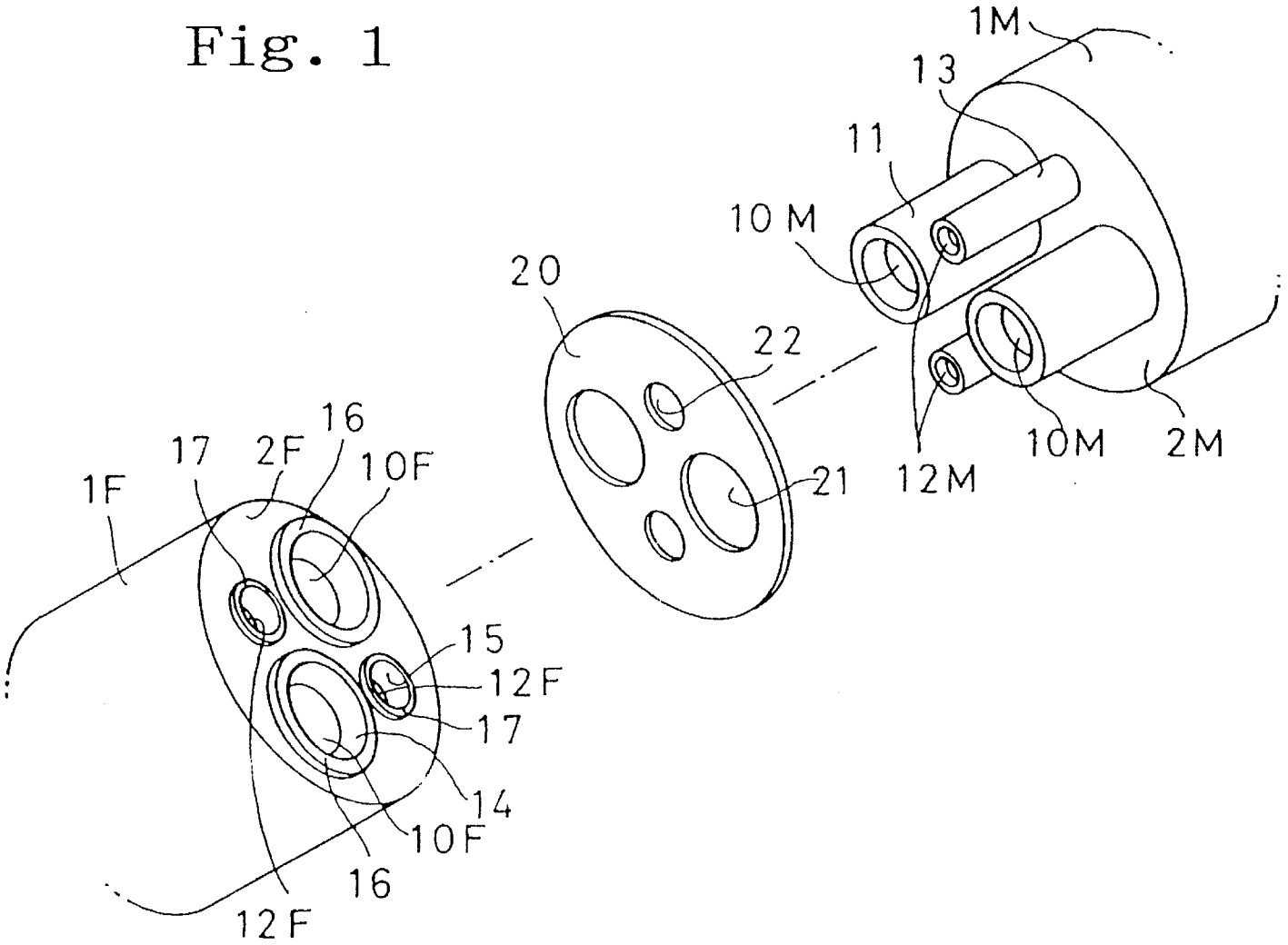
FIG. 1 is an exploded, perspective view diagrammatically showing one embodiment of a water-proof connector according to the present invention.
Figure 2:
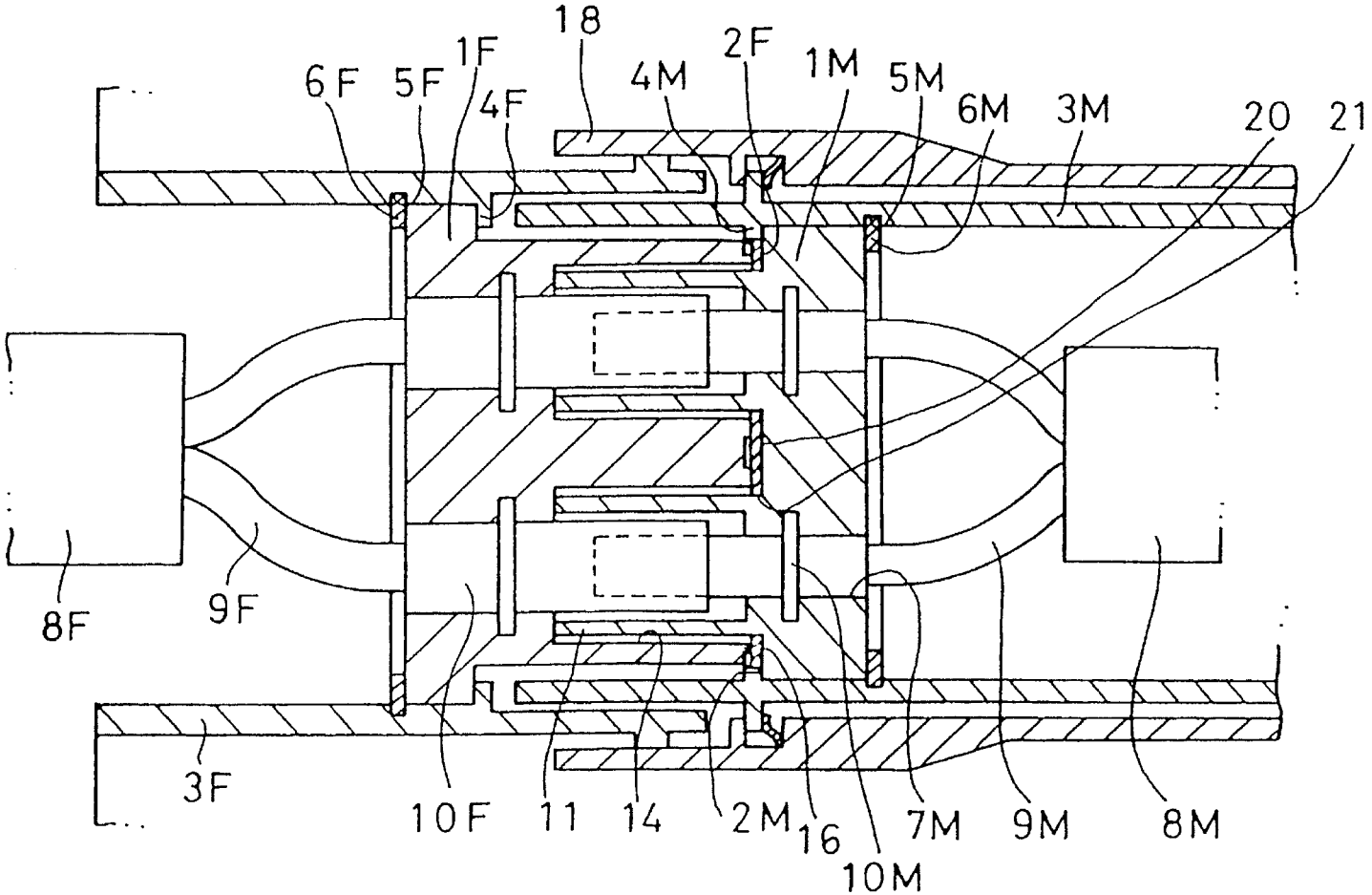
FIG. 2 a partial, enlarged, sectional view of the connector of FIG. 1 in a connected state.

FIGS. 1 and 2 depict one embodiment of a water-proof connector according to the present invention. The connector includes a first connector housing 1M having a front end surface 2M and a second connector housing 1F having a front end surface 2F. The first and second housings are adapted to be connected with each other with their front end surfaces 2M and 2F being in abutting engagement with each other.

The first housing 1M is disposed in a cylindrical casing 3M. The casing 3M has an annular, radially inwardly extending portion 4M with which the front end surface 2M of the housing 1M is engaged and an annular retainer ring 6M which is fitted in a groove 5M formed on an inside periphery thereof and with which a rear end portion of the housing 1M is engaged, so that the housing 1M is fixedly secured between the portion 4M and the retainer ring 6M. Designated by 18 is a shell provided on the outer periphery of the casing 3M.

The first housing 1M has a plurality of cavities 7 (two cavities in the illustrated embodiment) in each of which is received a male terminal (large current terminal) 1OM. The two male terminals 10M, 10M are electrically connected to respective lead wires 9M, 9M of a cable 8M extending from, for example, a charger (not shown). Each male terminal 10M protrudes from the front end surface 2M of the housing 1M. The end surface 2M is also provided with a plurality (two in the illustrated embodiment) of sleeves 11 surrounding respective male terminals 10M, 10M.

Similarly, the first housing 1M has a plurality of cavities (two cavities in the illustrated embodiment) in each of which is received a male terminal (small current terminal) 12M. The two male terminals 12M, 12M are used for confirming whether the first and second connector housings 1M and 1F are connected with each other. Each male terminal 12M protrudes from the front end surface 2M of the housing 1M. The end surface 2M is also provided with a plurality (two in the illustrated embodiment) of sleeves surrounding respective male terminals 12M, 12M.

The second housing 1F is disposed in a cylindrical casing 3F in the same manner as that of the first housing 1M. Thus, the casing 3F has an annular portion 4F with which the front end surface 2F of the housing 1F is engaged and an annular retainer ring 6F which is fitted in a groove 5F formed on an inside periphery thereof and with which a rear end portion of the housing 1F is engaged, so that the housing 1F is fixedly secured between the portion 4F and the retainer ring 6F.

The second housing 1F has a plurality of cavities 14 (two cavities in the illustrated embodiment) in each of which is received a female terminal (large current terminal) 10F engageable with the corresponding male terminal 10M. The two male terminals 10F, 10F are electrically connected to respective lead wires 9F, 9F of a cable 8F extending from, for example, a battery of an electric car (not shown). Each female terminal 10M has a front portion extending in the corresponding cavity 14 to define, between the outer periphery of the front portion and the inside periphery of the cavity 14, a space through which the corresponding sleeve 11 of the first housing 1M is insertible.

The second housing 1F also has a plurality of cavities 15 (two cavities in the illustrated embodiment) in each of which is received a female terminal (small current terminal) 12F engageable with the corresponding male terminal 12M. Each female terminal 12F has a front portion extending in the corresponding cavity 15 to define, between the outer periphery of the front portion and the inside periphery of the cavity 15, a space through which the corresponding sleeve 13 of the first housing 1M is insertible.

Provided on the front end surface 2M of the first housing 1M is a seal member 20 formed of a resilient material such as a rubber. The seal 21 member has a plurality of openings 21 and 22 (two large diameter openings 21 and two small diameter openings 22 in the illustrated embodiment) through which the sleeves 11 and 13 of the first housing 1M are inserted. The end surface 2F of the second housing 1F, on the other hand, is provided with a plurality of annular protrusions (two large diameter protrusions 16 and two small diameter protrusions 17) corresponding in number to the number of the openings 21 of the seal member 20 and adapted to surround the circumferences of the corresponding openings 21 when the first and second connector housings 1M and 1F are connected with each other.

The water-proof connector according to the above embodiment functions as follows.

In preparation for the charging the battery of the car, while positioning the male terminals 10M and 12M of the first housing 1M to coincide with the corresponding female terminals 10F and 12F of the second housing 1M, the front end portion of the casing 3M is inserted into a space between the casing 3F and the second housing 1F with the shell 18 of the casing 3M being fitted over the end portion of the casing 3F. As a result, the sleeves 11 and 13 of the first housing 1M are inserted through the openings 21 and 22 of the seal member 20 into the cavities 14 and 15, respectively, and, thus, received in respective spaces around the female terminals 10F and 12F. Simultaneously, the male terminals 10M and 12M are engaged with the corresponding female terminals 10F and 12F, whereby the battery of the car is electrically connected with the charger.

When the first and second housings 1M and 1F are properly connected with each other, an electrical signal indicative of the proper connection of the male and female terminals 12M and 12F is generated to permit the start of charging. Thus, a current flows through the male and female terminals 10M and 10F to effect charging of the battery.

In this state, the seal member 20, disposed between the end surfaces 2M and 2F of the first and second housings 1M and 1F, is tightly pressed between the end surface 2M of the first housing 1M and the annular protrusions 16 and 17 formed on the end surface 2F of the second housing 1F. As a consequence, pairs of the engaged terminals 10M/10F and 12M/12F are isolated from each other by the seal member 20.

Thus, even when water drops have deposited on the end surfaces 2M and 2F, outside and/or inside surfaces of the sleeves 11 and 13, interior surfaces of the cavities 14 and 15, and/or surfaces of the seal member 20, water is removed from those annular, pressed portions surrounding respective pairs of engaged electrodes and is prevented from flowing therethrough. Thus, an electrical current flowing through one pair of engaged terminals is prevented from leaking to another pair.

In the above embodiment, since each male terminal 10M and 12M is surrounded by a sleeve 11 or 13, the creeping distances between each male terminal and the end surface 2M and between two adjacent male terminals are increased, so that even if the seal member 20 becomes deteriorated by, for example, wearing upon a long use, there is little possibility of forming a leakage path of water between them.

Figure 3:
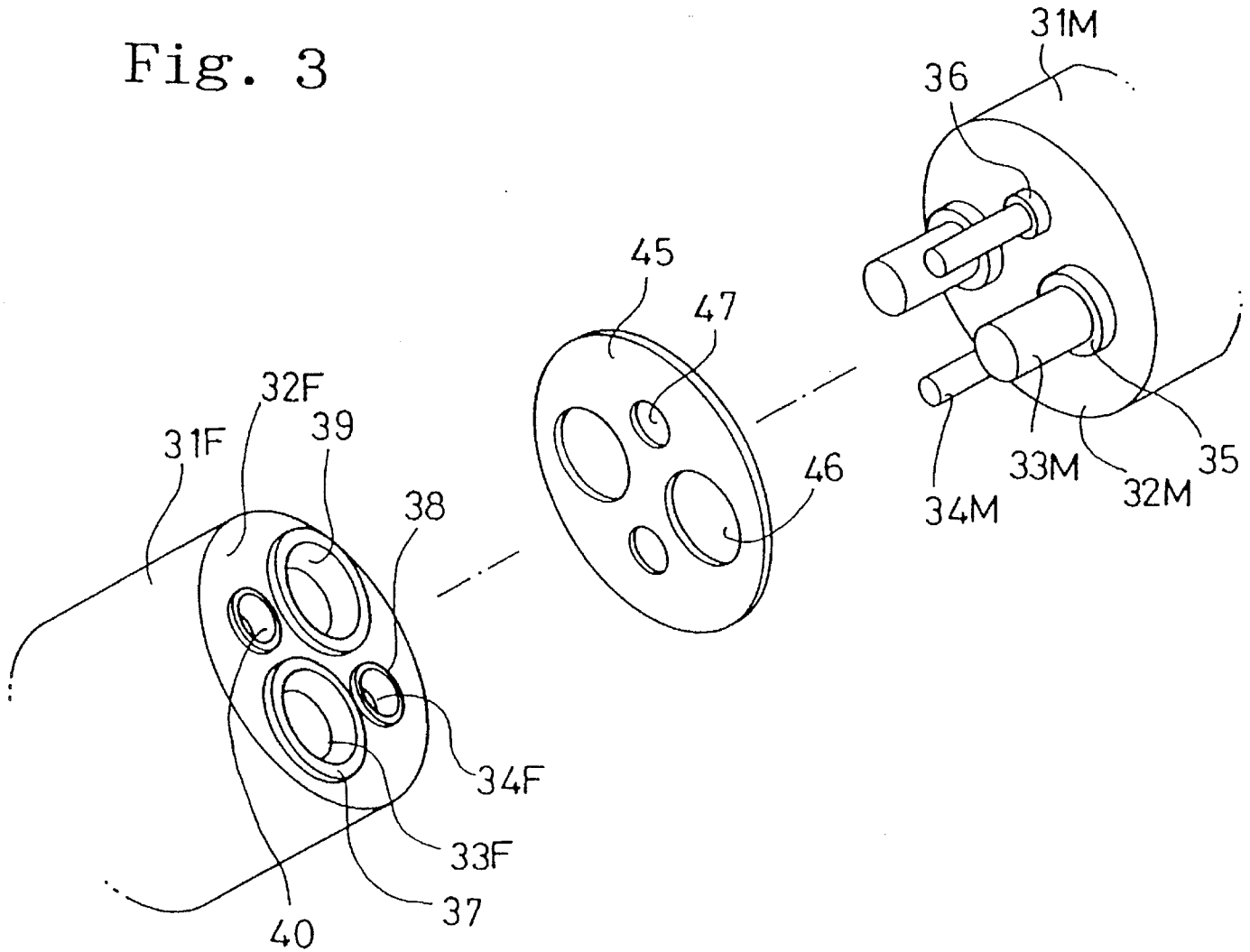
FIG. 3 is an exploded, perspective view, similar to FIG. 1, showing another embodiment of the present invention.
Figure 4:
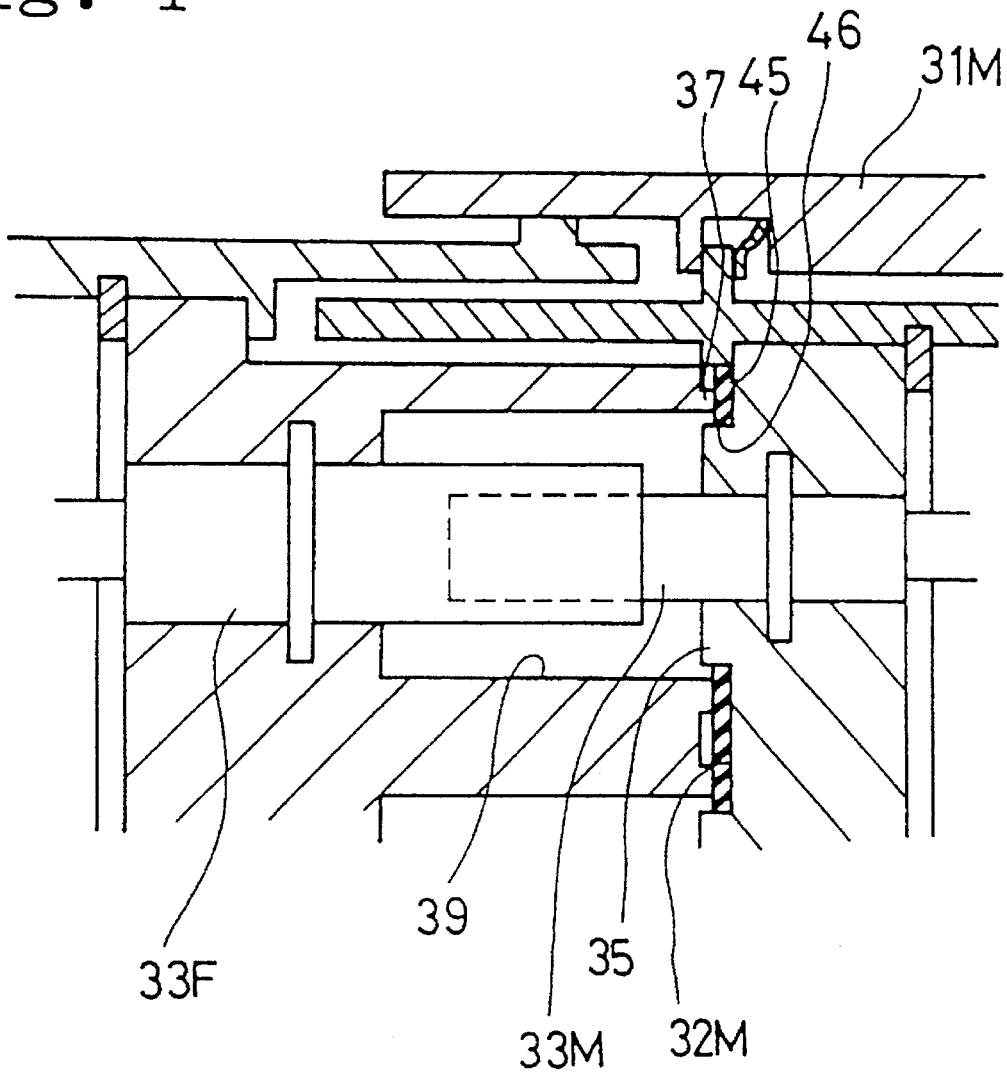
FIG. 4 is a partial, enlarged, sectional view of the connector of FIG. 3.

FIGS. 3 and 4 illustrate another embodiment of a connector according to the present invention in which the sleeves 11 and 13 in the above embodiment of FIGS. 1 and 2 are omitted. Designated by 31M is a first housing having an end surface 32M provided with annular protruded portions 35 and 36 through which male terminals 33M and 34M extend outwardly, respectively. Mounted on the end surface 32M is a resilient seal member 45 having openings 46 and 47 into which the protruded portions 35 and 36 of the first housing 31M are fitted, respectively. The connector also has a second housing 31F having an end surface 32F provided with cavities 39 and 40 arranged to receive therein the protruded portions 35 and 36 and the male terminals 33M and 34M of the first housing 31M. Disposed in the cavities 39 and 40 are female terminals 33F and 34F which are engageable with the corresponding male terminals 33M and 34M. The end surface 32F is provided with annular protrusions 37 and 38 at positions so as to surround the peripheries of respective openings 46 and 47 of the seal member 45 when the first and second housings 31M and 31F are connected with each other, with the seal member 45 being interposed therebetween.

As a result of the above structure, when the first and second housings 31M and 31F are properly connected with each other, the seal member 45 is tightly pressed between the end surface 32M of the first housing 31M and the annular protrusions 37 and 38 formed on the end surface 32F of the second housing 31F. As a consequence, pairs of the engaged terminals 33M/33F and 34M/34F are isolated from each other by the seal member 45. Thus, even when the end surfaces 32M and 32F, interior surfaces defining the cavities 39 and 40, and/or surfaces of the seal member 45 are wet, water is removed from those annular, pressed portions of the seal member 45 that surround respective pairs of engaged electrodes so that no leakage of an electrical current occurs between two pairs of engaged terminals.

Figure 5:
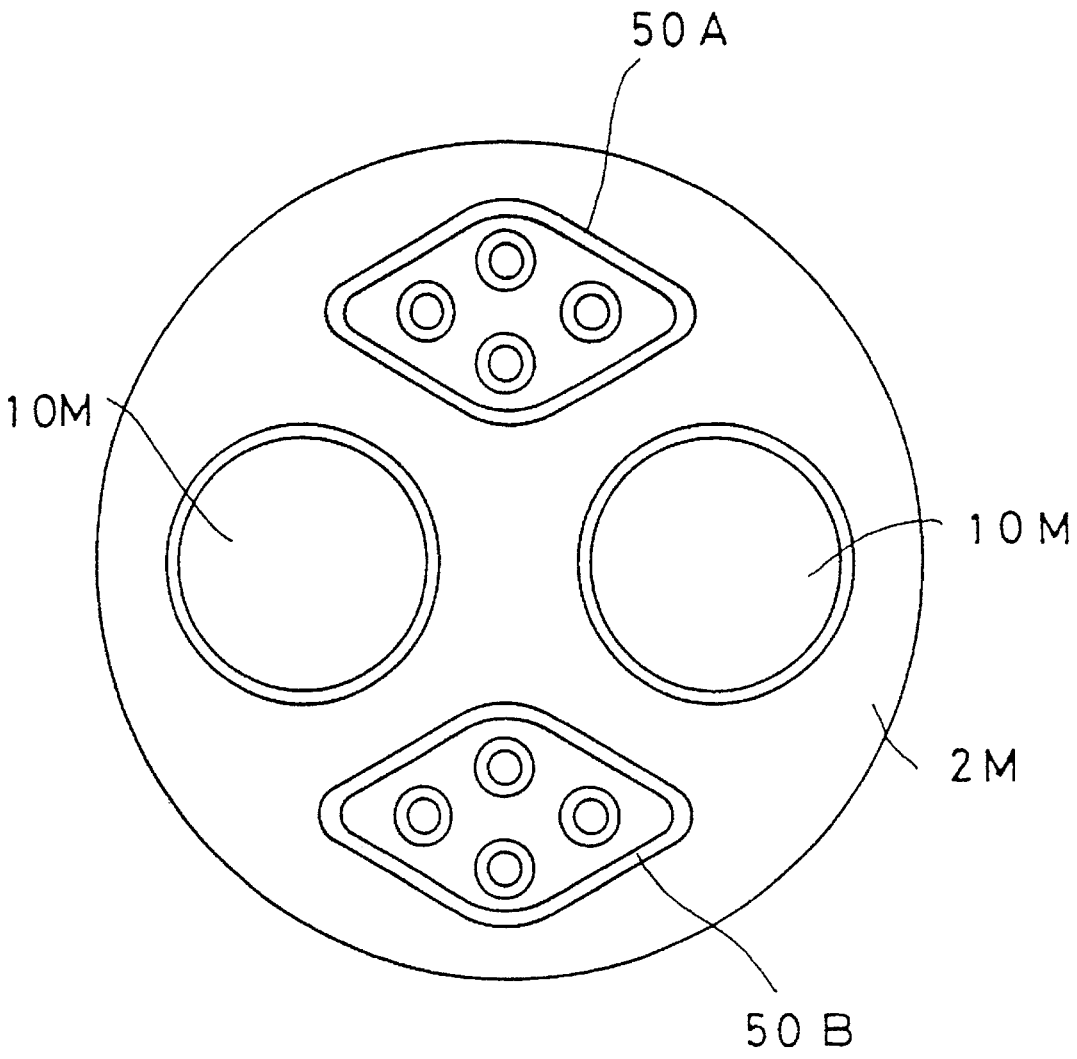
FIG. 5 is a front view schematically showing a male connector housing of a further embodiment of the present invention.
Figure 6:
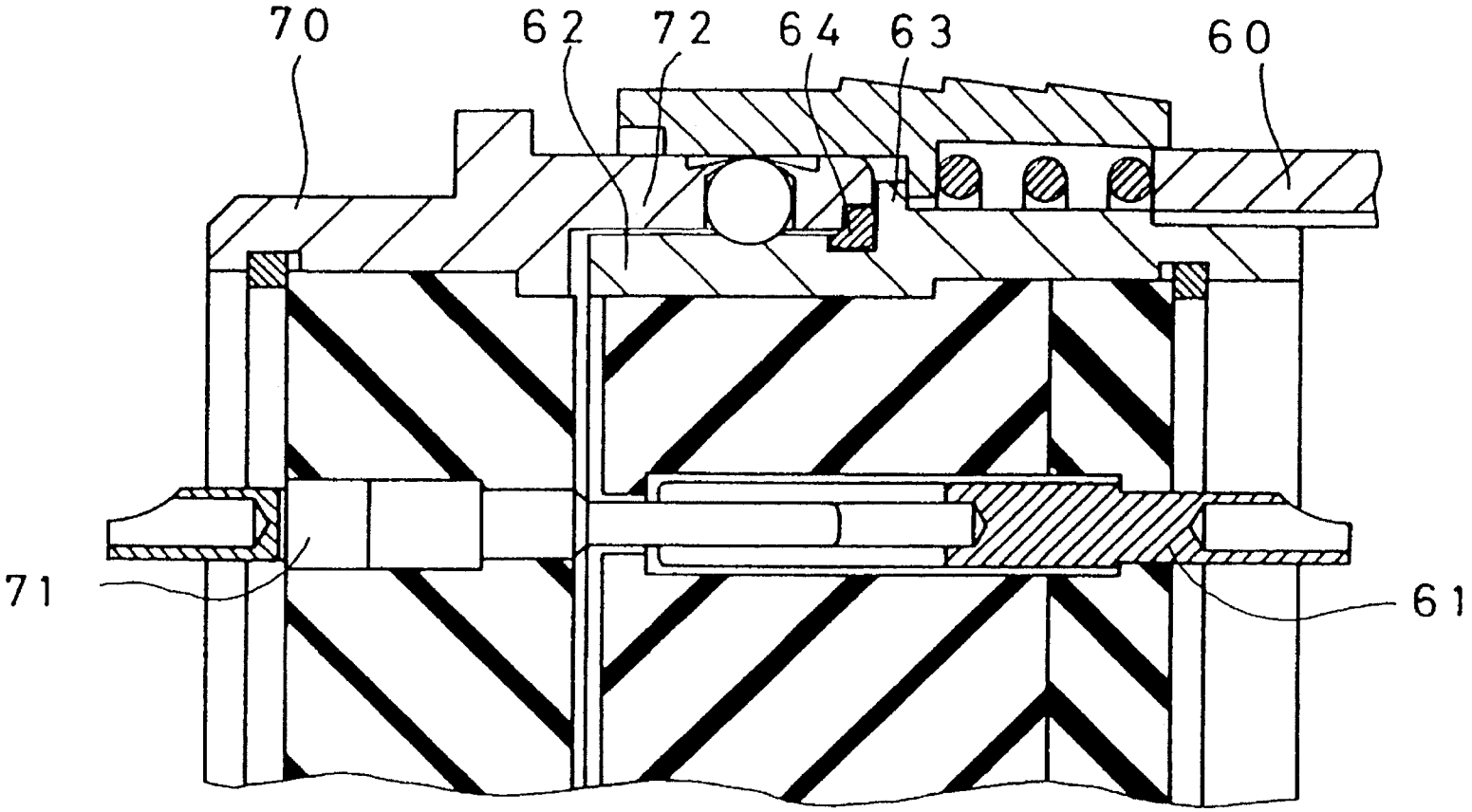
Fig. 6 PRIOR ART
FIG. 6 is a fragmentary sectional view diagrammatically showing a conventional water-proof structure.

While the foregoing embodiments use two relatively larger diameter, large current terminals and two relatively smaller diameter, small current terminals, any number and size of the terminals may be employed. FIG. 5 schematically illustrates an embodiment of a male terminal housing in which a plurality of signal input terminals (first group 50A) and another plurality of signal output terminals (second group 5OB) are provided in addition to two charging terminals 10M. In the illustrated case, each of the first and second groups of terminals 50A and 50B are jointly inserted into a respective one of openings of a seal member (not shown) and jointly sealed with the seal member.

The invention may be embodied in other specific forms without departing from the spirit or the essential characteristics thereof. For example, while, in the foregoing embodiments, annular protrusions 16, 17, 37 and 38 are formed on the end surfaces 2F and 32F of the second, female terminal housings 1F and 31F for the purpose of providing tight contact with the seal members 20 and 45, the satisfactory seal can be attained even in the absence of such protrusions. The seal member may be divided into several sections to separately surround respective male terminals. Further, the seal member may be fitted on the end surface 2F and 32F of the female terminal housing, if desired.

What is claimed is:

1. A water-proof connector comprising:

a first connector housing having an end surface;

a plurality of male terminals protruding from said end surface of said first connector housing;

a plurality of sleeves extending from said end surface of said first connector housing, said plurality of sleeves surrounding said plurality of male terminals, respectively;

a second connector housing having an end surface, and defining a plurality of cavities extending inwardly of said end surface thereof and which correspond in number to the number of said plurality of male terminals, said second connector housing further having a plurality of annular protrusions projecting from a peripheral edge of said plurality of cavities, respectively;

a female terminal, engageable with a corresponding said male terminal, disposed in each of said cavities; and a resilient seal lying against said end surface of one of said first and second connector housings and having a plurality of discrete openings arranged to correspond to said plurality of sleeves so that, when said first and second connector housings are mated with each other, said plurality of sleeves extend through said openings of said seal into said corresponding cavities and are electrically connected with said female terminals, respectively, wherein each of said annular protrusions surrounds a respective one of said openings of said resilient seal and presses against said resilient seal when said first and second connector housings are mated with each other such that said resilient seal is compressed by and between said end surface of said first connector housing and the annular protrusions of said second connector housing.

2. The connector as claimed in claim 1, wherein said sleeves are insertible into the cavities of said second connector housing, respectively.

3. The connector as claimed in claim 1, wherein said male terminals include relatively large current terminals and relatively small current terminals, and wherein said openings of said seal include a first group of openings and a second group of openings, said large current terminals extending through said first group of openings and said small current terminals extending through said second group of openings when said first and second connector housing are mated with each other.

4. The connector as claimed in claim 1, wherein said resilient seal is in the form of a plate.

5. The connector as claimed in claim 1, wherein said end surfaces of said first and second connector housings are planar.

6. The connector as claimed in claim 1, wherein said plurality of sleeves engage a bottom surface of said corresponding plurality of cavities when said first and second connector housings are mated.

7. The connector as claimed in claim 1, wherein said plurality of sleeves are spaced from said plurality of male terminals, respectively.

* * * * *